US009284812B2

(12) United States Patent
Mazyar

(10) Patent No.: US 9,284,812 B2
(45) Date of Patent: Mar. 15, 2016

(54) SYSTEM FOR INCREASING SWELLING EFFICIENCY

(71) Applicant: Oleg A. Mazyar, Houston, TX (US)

(72) Inventor: Oleg A. Mazyar, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 663 days.

(21) Appl. No.: 13/646,028

(22) Filed: Oct. 5, 2012

(65) Prior Publication Data

US 2013/0126185 A1 May 23, 2013

Related U.S. Application Data

(63) Continuation-in-part of application No. 13/300,916, filed on Nov. 21, 2011.

(51) Int. Cl.
*E21B 33/12* (2006.01)

(52) U.S. Cl.
CPC ..... *E21B 33/1208* (2013.01)

(58) Field of Classification Search
CPC ..... E21B 10/42; E21B 10/43; E21B 10/55; E21B 17/01; E21B 17/04; E21B 17/06; E21B 19/00; E21B 19/10; E21B 19/24; E21B 21/003; E21B 33/0355; E21B 33/038; E21B 33/1208; E21B 33/124; E21B 33/127; E21B 21/103; E21B 23/01; E21B 23/03; E21B 25/16; E21B 27/02; E21B 29/002; E21B 29/02; E21B 29/10; E21B 31/107; E21B 33/03; E21B 33/04; E21B 33/0422; E21B 33/06; E21B 33/062; E21B 33/063; E21B 33/12; C09K 8/588; C09K 8/80; C09K 3/30; C09K 8/10; C09K 8/58; C09K 8/584; C09K 8/68; C09K 8/805; C09K 8/905; C09K 2205/22; C09K 2205/40; C09K 2205/43; C09K 2208/00; C09K 3/00; C09K 5/04; C09K 8/422
See application file for complete search history.

(56) References Cited

U.S. PATENT DOCUMENTS

| | | | |
|---|---|---|---|
| 2,238,895 | A | 4/1941 | Gage |
| 2,261,292 | A | 11/1941 | Salnikov |
| 2,983,634 | A | 5/1961 | Budininkas et al. |
| 3,106,959 | A | 10/1963 | Huitt et al. |
| 3,152,009 | A | 10/1964 | DeLong |
| 3,326,291 | A | 6/1967 | Zandmer et al. |
| 3,390,724 | A | 7/1968 | Caldwell |
| 3,465,181 | A | 9/1969 | Colby et al. |
| 3,513,230 | A | 5/1970 | Rhees et al. |
| 3,637,446 | A | 1/1972 | Elliott et al. |
| 3,645,331 | A | 2/1972 | Maurer et al. |
| 3,775,823 | A | 12/1973 | Adolph et al. |
| 3,894,850 | A | 7/1975 | Kovalchuk et al. |
| 4,010,583 | A | 3/1977 | Highberg |
| 4,039,717 | A | 8/1977 | Titus |
| 4,157,732 | A | 6/1979 | Fonner |
| 4,248,307 | A | 2/1981 | Silberman et al. |
| 4,372,384 | A | 2/1983 | Kinney |
| 4,373,584 | A | 2/1983 | Silberman et al. |
| 4,374,543 | A | 2/1983 | Richardson |
| 4,384,616 | A | 5/1983 | Dellinger |
| 4,399,871 | A | 8/1983 | Adkins et al. |
| 4,422,508 | A | 12/1983 | Rutledge, Jr. et al. |
| 4,452,311 | A | 6/1984 | Speegle et al. |
| 4,498,543 | A | 2/1985 | Pye et al. |
| 4,499,048 | A | 2/1985 | Hanejko |
| 4,499,049 | A | 2/1985 | Hanejko |
| 4,534,414 | A | 8/1985 | Pringle |
| 4,539,175 | A | 9/1985 | Lichti et al. |
| 4,640,354 | A | 2/1987 | Boisson |
| 4,664,962 | A | 5/1987 | DesMarais, Jr. |
| 4,673,549 | A | 6/1987 | Ecer |
| 4,674,572 | A | 6/1987 | Gallus |
| 4,678,037 | A | 7/1987 | Smith |
| 4,681,133 | A | 7/1987 | Weston |
| 4,688,641 | A | 8/1987 | Knieriemen |
| 4,693,863 | A | 9/1987 | Del Corso et al. |
| 4,703,807 | A | 11/1987 | Weston |
| 4,706,753 | A | 11/1987 | Ohkochi et al. |
| 4,708,202 | A | 11/1987 | Sukup et al. |
| 4,708,208 | A | 11/1987 | Halbardier |
| 4,709,761 | A | 12/1987 | Setterberg, Jr. |
| 4,714,116 | A | 12/1987 | Brunner |
| 4,716,964 | A | 1/1988 | Erbstoesser et al. |

(Continued)

FOREIGN PATENT DOCUMENTS

| | | | |
|---|---|---|---|
| EP | 0662249 | * | 1/1997 |
| EP | 0662249 B1 | | 1/1997 |

(Continued)

OTHER PUBLICATIONS

Notification of Transmittal of the International Search Report and the Written Opinion of the International Searching Authority, or the Declaration; PCT/US2013/063501; Jan. 9, 2014; 17 pages.

Harry P. Gregor et al., "Studies on Ion Exchange Resins. XV. Selectivity Coefficients of Methacrylic Acid Resins Toward Alkali Metal Cations," The Journal of Physical Chemistry, Mar. 1956, vol. 60, pp. 263-267.

J.A. Marinsky et al., "Prediction of Ion-Exchange Selectivity," The Journal of Physical Chemistry, vol. 77, No. 17, 1973, pp. 2128-2132.

F. De Dardel, T.V. Arden, Ion exchangers, Ullmann's Encyclopedia of Industrial Chemistry, pp. 476-477, vol. 19, 2012, Wiley-VCH Verlag GmbH & Co. KGaA, Weinheim.

U.Lohbauer, Dental glassionomer cements as permanent filing materials?—Properties, limitaions and future trends, Materials, 2010, 3, 76-96, see p. 78-79.

(Continued)

*Primary Examiner* — Susannah Chung
*Assistant Examiner* — Kumar R Bhushan
(74) *Attorney, Agent, or Firm* — Cantor Colburn LLP

(57) ABSTRACT

A swellable system reactive to a flow of fluid including an article having a swellable material operatively arranged to swell upon exposure to a flow of fluid containing ions therein. A filter material is disposed with the swellable material and operatively arranged to remove the ions from the flow of fluid before exposure to the swellable material.

18 Claims, 2 Drawing Sheets

(56) References Cited

U.S. PATENT DOCUMENTS

| | | | |
|---|---|---|---|
| 4,721,159 | A | 1/1988 | Ohkochi et al. |
| 4,738,599 | A | 4/1988 | Shilling |
| 4,741,973 | A | 5/1988 | Condit et al. |
| 4,768,588 | A | 9/1988 | Kupsa |
| 4,784,226 | A | 11/1988 | Wyatt |
| 4,805,699 | A | 2/1989 | Halbardier |
| 4,817,725 | A | 4/1989 | Jenkins |
| 4,834,184 | A | 5/1989 | Streich et al. |
| H635 | H | 6/1989 | Johnson et al. |
| 4,850,432 | A | 7/1989 | Porter et al. |
| 4,853,056 | A | 8/1989 | Hoffman |
| 4,869,324 | A | 9/1989 | Holder |
| 4,869,325 | A | 9/1989 | Halbardier |
| 4,889,187 | A | 12/1989 | Terrell et al. |
| 4,890,675 | A | 1/1990 | Dew |
| 4,909,320 | A | 3/1990 | Hebert et al. |
| 4,929,415 | A | 5/1990 | Okazaki |
| 4,932,474 | A | 6/1990 | Schroeder, Jr. et al. |
| 4,944,351 | A | 7/1990 | Eriksen et al. |
| 4,949,788 | A | 8/1990 | Szarka et al. |
| 4,952,902 | A | 8/1990 | Kawaguchi et al. |
| 4,975,412 | A | 12/1990 | Okazaki et al. |
| 4,977,958 | A | 12/1990 | Miller |
| 4,981,177 | A | 1/1991 | Carmody et al. |
| 4,986,361 | A | 1/1991 | Mueller et al. |
| 5,006,044 | A | 4/1991 | Walker, Sr. et al. |
| 5,010,955 | A | 4/1991 | Springer |
| 5,036,921 | A | 8/1991 | Pittard et al. |
| 5,048,611 | A | 9/1991 | Cochran |
| 5,049,165 | A | 9/1991 | Tselesin |
| 5,063,775 | A | 11/1991 | Walker, Sr. et al. |
| 5,074,361 | A | 12/1991 | Brisco et al. |
| 5,084,088 | A | 1/1992 | Okazaki |
| 5,090,480 | A | 2/1992 | Pittard et al. |
| 5,095,988 | A | 3/1992 | Bode |
| 5,103,911 | A | 4/1992 | Heijnen |
| 5,117,915 | A | 6/1992 | Mueller et al. |
| 5,161,614 | A | 11/1992 | Wu et al. |
| 5,178,216 | A | 1/1993 | Giroux et al. |
| 5,181,571 | A | 1/1993 | Mueller et al. |
| 5,188,182 | A | 2/1993 | Echols, III et al. |
| 5,188,183 | A | 2/1993 | Hopmann et al. |
| 5,222,867 | A | 6/1993 | Walker, Sr. et al. |
| 5,226,483 | A | 7/1993 | Williamson, Jr. |
| 5,228,518 | A | 7/1993 | Wilson et al. |
| 5,234,055 | A | 8/1993 | Cornette |
| 5,252,365 | A | 10/1993 | White |
| 5,253,714 | A | 10/1993 | Davis et al. |
| 5,271,468 | A | 12/1993 | Streich et al. |
| 5,282,509 | A | 2/1994 | Schurr, III |
| 5,292,478 | A | 3/1994 | Scorey |
| 5,293,940 | A | 3/1994 | Hromas et al. |
| 5,309,874 | A | 5/1994 | Willermet et al. |
| 5,310,000 | A | 5/1994 | Arterbury et al. |
| 5,380,473 | A | 1/1995 | Bogue et al. |
| 5,392,860 | A | 2/1995 | Ross |
| 5,394,941 | A | 3/1995 | Venditto et al. |
| 5,398,754 | A | 3/1995 | Dinhoble |
| 5,407,011 | A | 4/1995 | Layton |
| 5,411,082 | A | 5/1995 | Kennedy |
| 5,417,285 | A | 5/1995 | Van Buskirk et al. |
| 5,425,424 | A | 6/1995 | Reinhardt et al. |
| 5,427,177 | A | 6/1995 | Jordan, Jr. et al. |
| 5,435,392 | A | 7/1995 | Kennedy |
| 5,439,051 | A | 8/1995 | Kennedy et al. |
| 5,454,430 | A | 10/1995 | Kennedy et al. |
| 5,456,317 | A | 10/1995 | Hood, III et al. |
| 5,456,327 | A | 10/1995 | Denton et al. |
| 5,464,062 | A | 11/1995 | Blizzard, Jr. |
| 5,472,048 | A | 12/1995 | Kennedy et al. |
| 5,474,131 | A | 12/1995 | Jordan, Jr. et al. |
| 5,477,923 | A | 12/1995 | Jordan, Jr. et al. |
| 5,479,986 | A | 1/1996 | Gano et al. |
| 5,526,880 | A | 6/1996 | Jordan, Jr. et al. |
| 5,526,881 | A | 6/1996 | Martin et al. |
| 5,529,746 | A | 6/1996 | Knoss et al. |
| 5,533,573 | A | 7/1996 | Jordan, Jr. et al. |
| 5,536,485 | A | 7/1996 | Kume et al. |
| 5,558,153 | A | 9/1996 | Holcombe et al. |
| 5,623,993 | A | 4/1997 | Van Buskirk et al. |
| 5,623,994 | A | 4/1997 | Robinson |
| 5,641,023 | A | 6/1997 | Ross et al. |
| 5,647,444 | A | 7/1997 | Williams |
| 5,677,372 | A | 10/1997 | Yamamoto et al. |
| 5,707,214 | A | 1/1998 | Schmidt |
| 5,709,269 | A | 1/1998 | Head |
| 5,720,344 | A | 2/1998 | Newman |
| 5,765,639 | A | 6/1998 | Muth |
| 5,772,735 | A | 6/1998 | Sehgal et al. |
| 5,782,305 | A | 7/1998 | Hicks |
| 5,797,454 | A | 8/1998 | Hipp |
| 5,826,652 | A | 10/1998 | Tapp |
| 5,826,661 | A | 10/1998 | Parker et al. |
| 5,829,520 | A | 11/1998 | Johnson |
| 5,836,396 | A | 11/1998 | Norman |
| 5,857,521 | A | 1/1999 | Ross et al. |
| 5,881,816 | A | 3/1999 | Wright |
| 5,934,372 | A | 8/1999 | Muth |
| 5,941,309 | A | 8/1999 | Appleton |
| 5,960,881 | A | 10/1999 | Allamon et al. |
| 5,985,466 | A | 11/1999 | Atarashi et al. |
| 5,990,051 | A | 11/1999 | Ischy et al. |
| 5,992,452 | A | 11/1999 | Nelson, II |
| 5,992,520 | A | 11/1999 | Schultz et al. |
| 6,007,314 | A | 12/1999 | Nelson, II |
| 6,024,915 | A | 2/2000 | Kume et al. |
| 6,047,773 | A | 4/2000 | Zeltmann et al. |
| 6,050,340 | A | 4/2000 | Scott |
| 6,069,313 | A | 5/2000 | Kay |
| 6,076,600 | A | 6/2000 | Vick, Jr. et al. |
| 6,079,496 | A | 6/2000 | Hirth |
| 6,085,837 | A | 7/2000 | Massinon et al. |
| 6,095,247 | A | 8/2000 | Streich et al. |
| 6,119,783 | A | 9/2000 | Parker et al. |
| 6,142,237 | A | 11/2000 | Christmas et al. |
| 6,161,622 | A | 12/2000 | Robb et al. |
| 6,167,970 | B1 | 1/2001 | Stout et al. |
| 6,173,779 | B1 | 1/2001 | Smith |
| 6,189,616 | B1 | 2/2001 | Gano et al. |
| 6,189,618 | B1 | 2/2001 | Beeman et al. |
| 6,213,202 | B1 | 4/2001 | Read, Jr. |
| 6,220,350 | B1 | 4/2001 | Brothers et al. |
| 6,228,904 | B1 | 5/2001 | Yadav et al. |
| 6,237,688 | B1 | 5/2001 | Burleson et al. |
| 6,238,280 | B1 | 5/2001 | Ritt et al. |
| 6,241,021 | B1 | 6/2001 | Bowling |
| 6,250,392 | B1 | 6/2001 | Muth |
| 6,261,432 | B1 | 7/2001 | Huber et al. |
| 6,273,187 | B1 | 8/2001 | Voisin, Jr. et al. |
| 6,276,452 | B1 | 8/2001 | Davis et al. |
| 6,276,457 | B1 | 8/2001 | Moffatt et al. |
| 6,279,656 | B1 | 8/2001 | Sinclair et al. |
| 6,287,445 | B1 | 9/2001 | Lashmore et al. |
| 6,302,205 | B1 | 10/2001 | Ryll |
| 6,315,041 | B1 | 11/2001 | Carlisle et al. |
| 6,315,050 | B2 | 11/2001 | Vaynshteyn et al. |
| 6,325,148 | B1 | 12/2001 | Trahan et al. |
| 6,328,110 | B1 | 12/2001 | Joubert |
| 6,341,653 | B1 | 1/2002 | Firmaniuk et al. |
| 6,341,747 | B1 | 1/2002 | Schmidt et al. |
| 6,349,766 | B1 | 2/2002 | Bussear et al. |
| 6,354,379 | B2 | 3/2002 | Miszewski et al. |
| 6,371,206 | B1 | 4/2002 | Mills |
| 6,380,456 | B1 | 4/2002 | Goldman |
| 6,382,244 | B2 | 5/2002 | Vann |
| 6,390,195 | B1 | 5/2002 | Nguyen et al. |
| 6,390,200 | B1 | 5/2002 | Allamon et al. |
| 6,394,185 | B1 | 5/2002 | Constien |
| 6,397,950 | B1 | 6/2002 | Streich et al. |
| 6,403,210 | B1 | 6/2002 | Stuivinga et al. |
| 6,408,946 | B1 | 6/2002 | Marshall et al. |
| 6,419,023 | B1 | 7/2002 | George et al. |
| 6,439,313 | B1 | 8/2002 | Thomeer et al. |
| 6,457,525 | B1 | 10/2002 | Scott |

(56) References Cited

U.S. PATENT DOCUMENTS 6,467,546 B2 10/2002 Allamon et al.
6,470,965 B1 10/2002 Winzer
6,491,097 B1 12/2002 Oneal et al.
6,491,116 B2 12/2002 Berscheidt et al.
6,508,305 B1 1/2003 Brannon et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,061 B2 5/2005 Hriscu et al.
6,899,176 B2 5/2005 Hailey, Jr. et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,108,080 B2 9/2006 Tessari et al.
7,111,682 B2 9/2006 Blaisdell
7,150,326 B2 12/2006 Bishop et al.
7,163,066 B2 1/2007 Lehr
7,168,494 B2 1/2007 Starr et al.
7,174,963 B2 2/2007 Bertelsen
7,182,135 B2 2/2007 Szarka
7,210,527 B2 5/2007 Walker et al.
7,210,533 B2 5/2007 Starr et al.
7,234,530 B2 6/2007 Gass
7,250,188 B2 7/2007 Dodelet et al.
7,255,172 B2 8/2007 Johnson
7,255,178 B2 8/2007 Slup et al.
7,264,060 B2 9/2007 Wills
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,320,365 B2 1/2008 Pia
7,322,412 B2 1/2008 Badalamenti et al.
7,322,417 B2 1/2008 Rytlewski et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,350,582 B2 4/2008 McKeachnie et al.
7,353,879 B2 4/2008 Todd et al.
7,360,593 B2 4/2008 Constien
7,360,597 B2 4/2008 Blaisdell
7,363,970 B2 4/2008 Corre et al.
7,387,165 B2 6/2008 Lopez de Cardenas et al.
7,401,648 B2 7/2008 Bennett
7,416,029 B2 8/2008 Telfer et al.
7,426,964 B2 9/2008 Lynde et al.
7,431,098 B2 10/2008 Ohmer et al.
7,441,596 B2 10/2008 Wood et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,399 B2 3/2009 Badalamenti et al.
7,509,993 B1 3/2009 Turng et al.
7,510,018 B2 3/2009 Williamson et al.
7,513,311 B2 4/2009 Gramstad et al.
7,527,103 B2 5/2009 Huang et al.
7,552,777 B2 6/2009 Murray et al.
7,552,779 B2 6/2009 Murray
7,559,357 B2 7/2009 Clem
7,575,062 B2 8/2009 East, Jr.
7,579,087 B2 8/2009 Maloney et al.
7,591,318 B2 9/2009 Tilghman
7,600,572 B2 10/2009 Slup et al.
7,604,049 B2 10/2009 Vaidya et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,511 B2 4/2010 Buyers et al.
7,708,078 B2 5/2010 Stoesz
7,709,421 B2 5/2010 Jones et al.
7,712,541 B2 5/2010 Loretz et al.
7,723,272 B2 5/2010 Crews et al.
7,726,406 B2 6/2010 Xu
7,757,773 B2 7/2010 Rytlewski
7,762,342 B2 7/2010 Richard et al.
7,770,652 B2 8/2010 Barnett
7,775,284 B2 8/2010 Richards et al.
7,775,286 B2 8/2010 Duphorne
7,784,543 B2 8/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,855,168 B2 12/2010 Fuller et al.
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.

(56) References Cited

U.S. PATENT DOCUMENTS

| | | | |
|---|---|---|---|
| 7,909,104 | B2 | 3/2011 | Bjorgum |
| 7,909,110 | B2 | 3/2011 | Sharma et al. |
| 7,913,765 | B2 | 3/2011 | Crow et al. |
| 7,931,093 | B2 | 4/2011 | Foster et al. |
| 7,938,191 | B2 | 5/2011 | Vaidya |
| 7,946,340 | B2 | 5/2011 | Surjaatmadja et al. |
| 7,958,940 | B2 | 6/2011 | Jameson |
| 7,963,331 | B2 | 6/2011 | Surjaatmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 8,020,619 | B1 | 9/2011 | Robertson et al. |
| 8,020,620 | B2 | 9/2011 | Daniels et al. |
| 8,025,104 | B2 | 9/2011 | Cooke, Jr. |
| 8,028,767 | B2 | 10/2011 | Radford et al. |
| 8,033,331 | B2 | 10/2011 | Themig |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 2001/0045285 | A1 | 11/2001 | Russell |
| 2001/0045288 | A1 | 11/2001 | Allamon et al. |
| 2002/0000319 | A1 | 1/2002 | Brunet |
| 2002/0007948 | A1 | 1/2002 | Bayne et al. |
| 2002/0014268 | A1 | 2/2002 | Vann |
| 2002/0066572 | A1 | 6/2002 | Muth |
| 2002/0104616 | A1 | 8/2002 | De et al. |
| 2002/0136904 | A1 | 9/2002 | Glass et al. |
| 2002/0162661 | A1 | 11/2002 | Krauss et al. |
| 2003/0037925 | A1 | 2/2003 | Walker et al. |
| 2003/0075326 | A1 | 4/2003 | Ebinger |
| 2003/0111728 | A1 | 6/2003 | Thai et al. |
| 2003/0141060 | A1 | 7/2003 | Hailey et al. |
| 2003/0141061 | A1 | 7/2003 | Hailey et al. |
| 2003/0141079 | A1 | 7/2003 | Doane et al. |
| 2003/0150614 | A1 | 8/2003 | Brown et al. |
| 2003/0155114 | A1 | 8/2003 | Pedersen et al. |
| 2003/0155115 | A1 | 8/2003 | Pedersen et al. |
| 2003/0159828 | A1 | 8/2003 | Howard et al. |
| 2003/0164237 | A1 | 9/2003 | Butterfield |
| 2003/0183391 | A1 | 10/2003 | Hriscu et al. |
| 2004/0005483 | A1 | 1/2004 | Lin |
| 2004/0020832 | A1 | 2/2004 | Richards et al. |
| 2004/0045723 | A1 | 3/2004 | Slup et al. |
| 2004/0089449 | A1 | 5/2004 | Walton et al. |
| 2004/0159428 | A1 | 8/2004 | Hammond et al. |
| 2004/0182583 | A1 | 9/2004 | Doane et al. |
| 2004/0231845 | A1 | 11/2004 | Cooke, Jr. |
| 2004/0256109 | A1 | 12/2004 | Johnson |
| 2004/0256157 | A1 | 12/2004 | Tessari et al. |
| 2005/0034876 | A1 | 2/2005 | Doane et al. |
| 2005/0051329 | A1 | 3/2005 | Blaisdell |
| 2005/0102255 | A1 | 5/2005 | Bultman |
| 2005/0161212 | A1 | 7/2005 | Leismer et al. |
| 2005/0161224 | A1 | 7/2005 | Starr et al. |
| 2005/0165149 | A1 | 7/2005 | Chanak et al. |
| 2005/0194143 | A1 | 9/2005 | Xu et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0241824 | A1 | 11/2005 | Burris, II et al. |
| 2005/0241825 | A1 | 11/2005 | Burris, II et al. |
| 2005/0257936 | A1 | 11/2005 | Lehr |
| 2006/0012087 | A1 | 1/2006 | Matsuda et al. |
| 2006/0045787 | A1 | 3/2006 | Jandeska, Jr. et al. |
| 2006/0057479 | A1 | 3/2006 | Niimi et al. |
| 2006/0081378 | A1 | 4/2006 | Howard et al. |
| 2006/0102871 | A1 | 5/2006 | Wang et al. |
| 2006/0108126 | A1 | 5/2006 | Horn et al. |
| 2006/0110615 | A1 | 5/2006 | Karim et al. |
| 2006/0116696 | A1 | 6/2006 | Odermatt et al. |
| 2006/0124310 | A1 | 6/2006 | Lopez de Cardenas |
| 2006/0124312 | A1 | 6/2006 | Rytlewski et al. |
| 2006/0131011 | A1 | 6/2006 | Lynde et al. |
| 2006/0131031 | A1 | 6/2006 | McKeachnie et al. |
| 2006/0144515 | A1 | 7/2006 | Tada et al. |
| 2006/0151178 | A1 | 7/2006 | Howard et al. |
| 2006/0162927 | A1 | 7/2006 | Walker et al. |
| 2006/0213670 | A1 | 9/2006 | Bishop et al. |
| 2006/0231253 | A1 | 10/2006 | Vilela et al. |
| 2006/0283592 | A1 | 12/2006 | Sierra et al. |
| 2007/0017674 | A1 | 1/2007 | Blaisdell |
| 2007/0017675 | A1 | 1/2007 | Hammami et al. |
| 2007/0029082 | A1 | 2/2007 | Giroux et al. |
| 2007/0039741 | A1 | 2/2007 | Hailey |
| 2007/0044958 | A1 | 3/2007 | Rytlewski et al. |
| 2007/0044966 | A1 | 3/2007 | Davies et al. |
| 2007/0051521 | A1 | 3/2007 | Fike et al. |
| 2007/0054101 | A1 | 3/2007 | Sigalas et al. |
| 2007/0056735 | A1 | 3/2007 | Bosma et al. |
| 2007/0057415 | A1 | 3/2007 | Katagiri et al. |
| 2007/0062644 | A1 | 3/2007 | Nakamura et al. |
| 2007/0074873 | A1 | 4/2007 | McKeachnie et al. |
| 2007/0107908 | A1 | 5/2007 | Vaidya et al. |
| 2007/0108060 | A1 | 5/2007 | Park |
| 2007/0119600 | A1 | 5/2007 | Slup et al. |
| 2007/0131912 | A1 | 6/2007 | Simone et al. |
| 2007/0151009 | A1 | 7/2007 | Conrad, III et al. |
| 2007/0151769 | A1 | 7/2007 | Slutz et al. |
| 2007/0169935 | A1 | 7/2007 | Akbar et al. |
| 2007/0181224 | A1 | 8/2007 | Marya et al. |
| 2007/0185655 | A1 | 8/2007 | Le Bemadjiel |
| 2007/0187095 | A1 | 8/2007 | Walker et al. |
| 2007/0221373 | A1 | 9/2007 | Murray |
| 2007/0221384 | A1 | 9/2007 | Murray |
| 2007/0259994 | A1 | 11/2007 | Tour et al. |
| 2007/0261862 | A1 | 11/2007 | Murray |
| 2007/0272411 | A1 | 11/2007 | Lopez De Cardenas et al. |
| 2007/0272413 | A1 | 11/2007 | Rytlewski et al. |
| 2007/0277979 | A1 | 12/2007 | Todd et al. |
| 2007/0284109 | A1 | 12/2007 | East et al. |
| 2008/0020923 | A1 | 1/2008 | Debe et al. |
| 2008/0047707 | A1 | 2/2008 | Boney et al. |
| 2008/0060810 | A9 | 3/2008 | Nguyen et al. |
| 2008/0066923 | A1 | 3/2008 | Xu |
| 2008/0066924 | A1 | 3/2008 | Xu |
| 2008/0078553 | A1 | 4/2008 | George |
| 2008/0081866 | A1 | 4/2008 | Gong et al. |
| 2008/0099209 | A1 | 5/2008 | Loretz et al. |
| 2008/0105438 | A1 | 5/2008 | Jordan et al. |
| 2008/0115932 | A1 | 5/2008 | Cooke |
| 2008/0121436 | A1 | 5/2008 | Slay et al. |
| 2008/0127475 | A1 | 6/2008 | Griffo |
| 2008/0149325 | A1 | 6/2008 | Crawford |
| 2008/0149345 | A1 | 6/2008 | Marya et al. |
| 2008/0149351 | A1 | 6/2008 | Marya et al. |
| 2008/0169105 | A1 | 7/2008 | Williamson et al. |
| 2008/0179104 | A1 | 7/2008 | Zhang et al. |
| 2008/0202764 | A1 | 8/2008 | Clayton et al. |
| 2008/0223586 | A1 | 9/2008 | Barnett |
| 2008/0223587 | A1 | 9/2008 | Cherewyk |
| 2008/0236829 | A1 | 10/2008 | Lynde |
| 2008/0248205 | A1 | 10/2008 | Blanchet et al. |
| 2008/0277109 | A1 | 11/2008 | Vaidya |
| 2008/0277980 | A1 | 11/2008 | Koda et al. |
| 2008/0296024 | A1 | 12/2008 | Huang et al. |
| 2008/0314581 | A1 | 12/2008 | Brown |
| 2008/0314588 | A1 | 12/2008 | Langlais et al. |
| 2009/0038858 | A1 | 2/2009 | Griffo et al. |
| 2009/0044946 | A1 | 2/2009 | Schasteen et al. |
| 2009/0044949 | A1 | 2/2009 | King et al. |
| 2009/0084550 | A1 | 4/2009 | Korte et al. |
| 2009/0084556 | A1 | 4/2009 | Richards et al. |
| 2009/0084600 | A1 | 4/2009 | Severance |
| 2009/0101355 | A1 | 4/2009 | Peterson et al. |
| 2009/0107684 | A1 | 4/2009 | Cooke, Jr. |
| 2009/0145666 | A1 | 6/2009 | Radford et al. |
| 2009/0152009 | A1 | 6/2009 | Slay et al. |
| 2009/0159289 | A1 | 6/2009 | Avant et al. |
| 2009/0178808 | A1 | 7/2009 | Williamson et al. |
| 2009/0194273 | A1 | 8/2009 | Surjaatmadja et al. |
| 2009/0205841 | A1 | 8/2009 | Kluge et al. |
| 2009/0226340 | A1 | 9/2009 | Marya |
| 2009/0242202 | A1 | 10/2009 | Rispler et al. |

(56) References Cited

U.S. PATENT DOCUMENTS

| | | | |
|---|---|---|---|
| 2009/0242208 | A1 | 10/2009 | Bolding |
| 2009/0242214 | A1 | 10/2009 | Foster et al. |
| 2009/0255667 | A1 | 10/2009 | Clem et al. |
| 2009/0255686 | A1 | 10/2009 | Richard et al. |
| 2009/0260817 | A1 | 10/2009 | Gambier et al. |
| 2009/0272544 | A1 | 11/2009 | Giroux et al. |
| 2009/0283270 | A1 | 11/2009 | Langeslag |
| 2009/0301730 | A1 | 12/2009 | Gweily |
| 2009/0308588 | A1 | 12/2009 | Howell et al. |
| 2009/0317556 | A1 | 12/2009 | Macary |
| 2010/0015002 | A1 | 1/2010 | Barrera et al. |
| 2010/0025255 | A1 | 2/2010 | Su et al. |
| 2010/0032151 | A1 | 2/2010 | Duphorne |
| 2010/0044041 | A1 | 2/2010 | Smith et al. |
| 2010/0051278 | A1 | 3/2010 | Mytopher et al. |
| 2010/0089583 | A1 | 4/2010 | Xu et al. |
| 2010/0089587 | A1 | 4/2010 | Stout |
| 2010/0101803 | A1 | 4/2010 | Clayton et al. |
| 2010/0139930 | A1 | 6/2010 | Patel et al. |
| 2010/0147507 | A1 | 6/2010 | Korte et al. |
| 2010/0200230 | A1 | 8/2010 | East, Jr. et al. |
| 2010/0236793 | A1 | 9/2010 | Bjorgum |
| 2010/0236794 | A1 | 9/2010 | Duan et al. |
| 2010/0243254 | A1 | 9/2010 | Murphy et al. |
| 2010/0252273 | A1 | 10/2010 | Duphorne |
| 2010/0252280 | A1 | 10/2010 | Swor et al. |
| 2010/0256018 | A1* | 10/2010 | Ezell ..... C09K 8/512 507/119 |
| 2010/0270031 | A1 | 10/2010 | Patel |
| 2010/0294510 | A1 | 11/2010 | Holmes |
| 2010/0326649 | A1 | 12/2010 | Spacey et al. |
| 2011/0005773 | A1 | 1/2011 | Dusterhoft et al. |
| 2011/0036592 | A1 | 2/2011 | Fay |
| 2011/0048743 | A1 | 3/2011 | Stafford et al. |
| 2011/0056692 | A1 | 3/2011 | Lopez de Cardenas et al. |
| 2011/0067872 | A1 | 3/2011 | Agrawal |
| 2011/0067889 | A1 | 3/2011 | Marya et al. |
| 2011/0067890 | A1 | 3/2011 | Themig |
| 2011/0100643 | A1 | 5/2011 | Themig et al. |
| 2011/0127044 | A1 | 6/2011 | Radford et al. |
| 2011/0132143 | A1 | 6/2011 | Xu et al. |
| 2011/0132612 | A1 | 6/2011 | Agrawal et al. |
| 2011/0132619 | A1 | 6/2011 | Agrawal et al. |
| 2011/0132620 | A1 | 6/2011 | Agrawal et al. |
| 2011/0132621 | A1 | 6/2011 | Agrawal et al. |
| 2011/0135530 | A1 | 6/2011 | Xu et al. |
| 2011/0135805 | A1 | 6/2011 | Doucet et al. |
| 2011/0135953 | A1 | 6/2011 | Xu et al. |
| 2011/0136707 | A1 | 6/2011 | Xu et al. |
| 2011/0139465 | A1 | 6/2011 | Tibbles et al. |
| 2011/0139466 | A1 | 6/2011 | Chen et al. |
| 2011/0147014 | A1 | 6/2011 | Chen et al. |
| 2011/0186306 | A1 | 8/2011 | Marya et al. |
| 2011/0247833 | A1 | 10/2011 | Todd et al. |
| 2011/0253387 | A1 | 10/2011 | Ervin |
| 2011/0259610 | A1 | 10/2011 | Shkurti et al. |
| 2011/0277987 | A1 | 11/2011 | Frazier |
| 2011/0277989 | A1 | 11/2011 | Frazier |
| 2011/0284232 | A1 | 11/2011 | Huang |
| 2011/0284243 | A1 | 11/2011 | Frazier |
| 2012/0175134 | A1* | 7/2012 | Robisson ..... E21B 33/1208 166/387 |
| 2012/0202047 | A1* | 8/2012 | Welch ..... B32B 5/16 428/323 |
| 2012/0227986 | A1* | 9/2012 | Sevre ..... E21B 33/1208 166/387 |
| 2013/0126190 | A1 | 5/2013 | Mazyar et al. |

FOREIGN PATENT DOCUMENTS

| | | | |
|---|---|---|---|
| EP | 1798301 | A1 | 8/2006 |
| EP | 2282001 | * | 2/2011 |
| EP | 2282001 | A2 | 2/2011 |
| GB | 912956 | | 12/1962 |
| JP | 61067770 | | 4/1986 |
| JP | 2000185725 | A1 | 7/2000 |
| JP | 2004225084 | | 8/2004 |
| JP | 2004225765 | A | 8/2004 |
| JP | 2005076052 | A | 3/2005 |
| JP | 2010502840 | A | 1/2010 |
| WO | 2008057045 | A1 | 5/2008 |
| WO | WO2008079485 | | 7/2008 |
| WO | WO2012/128747 | * | 9/2012 |

OTHER PUBLICATIONS

V. Smuleac, et al., "Polythiol-functionalized alumina membranes for mercury capture" Journal of Membrane Science 251 (2005) 169-178 Elsevier, www.sciencedirect.com, Nov. 15, 2004.

Wei Gao, et al., " Engineered Graphite Oxide Materials for Application in Water Purification" Applied Materials & Interfaces, ACS Publications 2011 American Chemical Society, www.acsami.org, research article, pp. 1821-1826.

Masahiro Toyoda, et al. "Heavy oil sorption using exfoliated graphite New application of exfoliated graphite to protect heavy oil pollution", Carbon 38 (2000) 199-210, PERGAMON, May 25, 1999.

Masahiro Toyoda, et al., "Sorption and recovery of heavy oil by using exfoliated graphite" Elsevier, Desalination 115 (1998) 199-201, Mar. 10, 1998.

Toshiaki Enoki, et al., "Graphite Intercalation Compounds and Applications" Oxford Universite Press, 2003, Exfoliated Graphite Formed by Intercalation, www.oup.com, pp. 401-413.

Hybrid Plastics, Inc., "MA0735 POSS: Flow & Dispersion Aid for NBR/HNBR Reinforcemment" Superior Technology for Superior Products, Komalska, et al., Materials Science Forum vol. 714 (2012) 175-181, www.hybridplastics.com, p. 1.

Abdoulaye Seyni, Nadine Le Bolay, Sonia Molina-Boisseau, "On the interest of using degradable fillers in co-ground composite materials", Powder Technology 190, (2009) pp. 176-184.

Ambat, et al.; "Electroless Nickel-Plating on AZ91D Magnesium Alloy: Effect of Substrate Microstructure and Plating Parameters"; Surface and Coatings Technology; 179; pp. 124-134; (2004).

Oleg A. Mazyar et al., pending U.S. Appl. No. 13/300,916 entitled "Ion-Exchange Method of Swellable Packer Deployment," filed with the U.S. Patent and Trademark Office on Nov. 21, 2011.

Baker Hughes Tools. "Baker Oil Tools Introduces Revolutionary Sand Control Completion Technology," May 2, 2005.

E. Paul Bercegeay et al., "A One-Trip Gravel Packing System"; Society of Petroleum Engineers, Offshort Technology Conference, SPE Paper No. 4771; Feb. 7-8, 1974.

Bybee, Karen. "One-Trip Completion System Eliminates Perforations," Completions Today, Sep. 2007, pp. 52-53.

CH. Christoglou, N. Voudouris, G.N. Angelopoulos, M. Pant, W. Dahl, "Deposition of Aluminum on Magnesium by a CVD Process", Surface and Coatings Technology 184 (2004) 149-155.

Chang, et al.; "Electrodeposition of Aluminum on Magnesium Alloy in Aluminum Chloride (A1C13)-1-ethyl-3-methylimidazolium chloride (EMIC) Ionic Liquid and Its Corrosion Behavior"; Electrochemistry Communications; 9; pp. 1602-1606; (2007).

Chun-Lin, Li. "Design of Abrasive Water Jet Perforation and Hydraulic Fracturing Tool," Oil Field Equipment, Mar. 2011.

Constantin Vahlas, BRI Gitte Caussat, Philippe Serp, George N. Angelopoulos, "Principles and Applications of CVD Powder Technology", Materials Science and Engineering R 53 (2006) 1-72.

Curtin, William and Brian Sheldon. "CNT-reinforced ceramics and metals," Materials Today, 2004, vol. 7, 44-49.

Yi Feng, Hailong Yuan, "Electroless Plating of Carbon Nanotubes with Silver" Journal of Materials Science, 39, (2004) pp. 3241-3243.

E. Flahaut et al., "Carbon Nanotube-Metal-Oxide Nanocomposites: Microstructure, Electrical Conductivity and Mechanical Properties" Acta mater. 48 (2000) 3803-3812.

Flow Control Systems, [online]; [retrieved on May 20, 2010]; retrieved from the Internet http://www.bakerhughes.com/products-and-services/completions-and-productions/well-completions/packers-and-flow-control/flow-control-systems.

(56) References Cited

OTHER PUBLICATIONS

Forsyth, et al.; "Exploring Corrosion Protection of Mg Via Ionic Liquid Pretreatment"; Surface & Coatings Technology; 201; pp. 4496-4504; (2007).
Galanty et al. "Consolidation of metal powders during the extrusion process," Journal of Materials Processing Technology (2002), pp. 491-496.
C.S. Goh, J. Wei, L C Lee, and M. Gupta, "Development of novel carbon nanotube reinforced magnesium nanocomposites using the powder metallurgy technique", Nanotechnology 17 (2006) 7-12.
Guan Ling Song, Andrej Atrens "Corrosion Mechanisms of Magnesium Alloys", Advanced Engineering Materials 1999, 1, No. 1, pp. 11-33.
H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.
Hjortstam et al. "Can we achieve ultra-low resistivity in carbon nanotube-based metal composites," Applied Physics A (2004), vol. 78, Issue 8, pp. 1175-1179.
Hsiao et al.; "Effect of Heat Treatment on Anodization and Electrochemical Behavior of AZ91D Magnesium Alloy"; J. Mater. Res.; 20(10); pp. 2763-2771;(2005).
Hsiao, et al.; "Anodization of AZ91D Magnesium Alloy in Silicate-Containing Electrolytes"; Surface & Coatings Technology; 199; pp. 127-134; (2005).
Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).
Hsiao, et al.; "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
International Search Report and Written Opinion of the International Searching Authority, or the Declaration for PCT/US2011/058105 mailed from the Korean Intellectual Property Office on May 1, 2012.
Notification of Transmittal of the International Search Report and the Written Opinion of the International Searching Authority, or the Declaration mailed on Feb. 23, 2012 (Dated Feb. 22, 2012) for PCT/US2011/043036.
International Search Report and Written Opinion of the International Searching Authority for International Application No. PCT/US2011/058099 (filed on Oct. 27, 2011), mailed on May 11, 2012.
International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.
Notification of Transmittal of the International Search Report and the Written Opinion of the International Searching Authority; PCT/US2010/059257; Korean Intellectual Property Office; Mailed Jul. 27, 2011.
Notification of Transmittal of the International Search Report and the Written Opinion of the International Searching Authority; PCT/US2010/059259; International Searching Authority KIPO; Mailed Jun. 13, 2011.
Notification of Transmittal of the International Search Report and the Written Opinion of the International Searching Authority; PCT/US2010/059265; International Searching Authority KIPO; Mailed Jun. 16, 2011.
Notification of Transmittal of the International Search Report and the Written Opinion of the International Searching Authority; PCT/US2010/059268; International Searching Authority KIPO; Mailed Jun. 17, 2011.
Notification of Transmittal of the International Search Report and the Written Opinion of the International Searching Authority; PCT/US2011/047000; Korean Intellectual Property Office; Mailed Dec. 26, 2011; 8 pages.
J. Dutta Majumdar, B. Ramesh Chandra, B.L. Mordike, R. Galun, I. Manna, "Laser Surface Engineering of a Magnesium Alloy with Al+Al2O3", Surface and Coatings Technology 179 (2004) 297-305.
J.E. Gray, B. Loan, "Protective Coatings on Magnesium and Its Alloys—a Critical Review", Journal of Alloys and Compounds 336 (2002) 88-113.
Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.
Liu, et al.; "Electroless Nickel Plating on AZ91 Mg Alloy Substrate"; Surface & Coatings Technology; 200; pp. 5087-5093; (2006).
Lunder et al.; "The Role of Mg17Al12 Phase in the Corrosion of Mg Alloy AZ91"; Corrosion; 45(9); pp. 741-748; (1989).
M. Toyoda et al., "Sorption and recovery of heavy oil by using exfoliated graphite," Desalination 115 (1998), pp. 199-201.
M. Toyoda et al., "Heavy oil sorption using exfoliated graphite New application of exfoliated graphite to protect heavy oil pollution," Carbon 38 (2000), pp. 199-210.
Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.
Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.
Optisleeve Sliding Sleeve, [online]; [retrieved on Jun. 25, 2010]; retrieved from the Internet weatherford.com/weatherford/groups/.../weatherfordcorp/WFT033159.pdf.
Pardo, et al.; "Corrosion Behaviour of Magnesium/Aluminium Alloys in 3.5 wt% NaC1"; Corrosion Science; 50; pp. 823-834; (2008).
Notification of Transmittal of the International Search Report and Written Opinion, Mailed Jul. 8, 2011, International Appln. No. PCT/US2010/059263, Written Opinion 4 Pages, International Search Report 3 Pages.
Shi et al.; "Influence of the Beta Phase on the Corrosion Performance of Anodised Coatings on Magnesium—Aluminium Alloys"; Corrosion Science; 47; pp. 2760-2777; (2005).
Shimizu et al., "Multi-walled carbon nanotube-reinforced magnesium alloy composites", Scripta Materialia, vol. 58, Issue 4, pp. 267-270.
"Sliding Sleeve", Omega Completion Technology Ltd, Sep. 29, 2009, retrieved on: www.omega-completion.com.
International Search Report and Written Opinion, International Appln No. PCT/US2012/061102, Date of Mailing Mar. 29, 2013, Korean Intellectual Preporty Office, Written Opinion 5 pages; International Search Report 4 pages.

* cited by examiner

SYSTEM FOR INCREASING SWELLING EFFICIENCY

CROSS REFERENCE

This application is a continuation-in-part of U.S. Non-provisional application Ser. No. 13/300,916 filed on Nov. 21, 2011.

BACKGROUND

Isolation of downhole environments depends on the deployment of a downhole tool that effectively seals the entirety of the borehole or a portion thereof, for example, an annulus between a casing wall and production tube. Swellable packers, for example, are particularly useful in that they automatically expand to fill the cross-sectional area of a borehole in response to one or more downhole fluids. Consequently, swellable packers can be placed in borehole locations that have a smaller inner diameter than the cross-sectional area of the fully expanded swellable packer. However, certain downhole conditions, such as the presence of monovalent and polyvalent cations (e.g., $Ca^{2+}$, $Zn^{2+}$, etc.) in the aqueous downhole fluids contacting the swellable packer, tend to decrease both the amount of swelling and the rate at which the packer swells, and may also accelerate degradation of the packer. In order to overcome these issues and to continually improve upon swelling efficiency under a variety of conditions, the industry is always desirous of new and alternate swelling systems.

SUMMARY

A swellable system reactive to a flow of fluid, including an article including a swellable material operatively arranged to swell upon exposure to a flow of fluid, the flow of fluid containing ions therein; and a filter material disposed with the swellable material and operatively arranged to remove the ions from the flow of fluid before exposure to the swellable material.

A method of operating a swellable system including filtering ions from a flow of fluid with a filter material; and swelling a swellable material responsive to the flow of fluid upon exposure to the fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
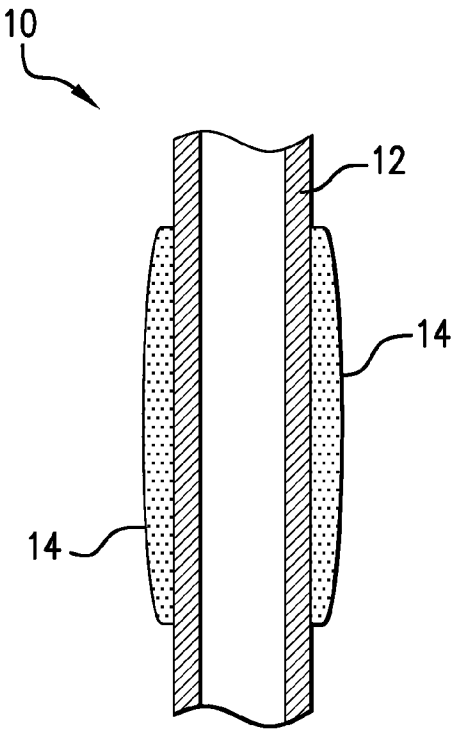
FIG. 1 is a cross-sectional view of a swellable article in an initial configuration.

Referring now to FIG. 1, a system 10 including a tubular or string 12 and a downhole article 14, e.g., a packer or sealing element, disposed thereon is illustrated. The downhole article 14 includes, for example, a base composition and a filter component, discussed in more detail below. The base composition comprises an elastomeric material and/or an absorbent material. Due to fluid absorption by the absorbent material, e.g. absorption of water, brine, hydrocarbons, etc., the article 14 expands or swells to a second configuration shown in FIG. 2. Various absorbent materials are known and used in the art. For example, with respect to water swellable embodiments any so-called Super Absorbent Polymer could be used, or those marketed by Nippon Shokubai Co., Ltd. under the name AQUALIC® CS-6S. The elastomeric material is included, for example, to provide a seal against a downhole structure 16, e.g., a borehole in a subterranean formation 18, shown in FIG. 2. Of course, the structure 16 could be any other tubing, casing, liner, etc. located downhole and engagable by the article 14. The elastomeric material could be any swellable or non-swellable material. In some embodiments, the elastomeric material is absorbent with respect to one or more downhole fluids thus also encompassing the absorbent material. In this way, for example, the article 14 can be run-in having an initially radially compressed configuration, exposed to fluids once located downhole, and expanded to engage between the tubular 12 and the structure 16. In one embodiment, the structure 16 is isolated by expansion of the article 14 such that fluids (e.g., from the formation 18) are substantially prevented from flowing past the article 14 once the article 14 is expanded.

Downhole fluids typically comprise an aqueous component, which more accurately is a brine containing various ions, e.g., metal cations from dissolved salts. As noted above, monovalent and polyvalent cations can interact with the absorbent material, and decrease the overall rate and ratio of expansion of the absorbent material, thereby hindering the sealing efficacy of the article. It has been generally found that polyvalent cations such as $Ca^{2+}$, $Zn^{2+}$, etc. have a more profound effect on the performance of swellable materials, particularly in water swellable articles, than monovalent cations and are thus usually more desirable to be removed. It is to be appreciated that while water-swellable materials are discussed as an exemplary embodiment that is adversely affected by the presence of cations, other materials may be swellable in response to different fluids and/or adversely affected by anions. For example, in one embodiment the swellable material is adversely affected (e.g., reduced swelling, shorter life span, slower swelling rate, etc.) by the presence of anions. For this reason, the term "ions" as used herein will refer to any cation or anion that has a negative effect on the performance of a corresponding swellable material.

To mitigate the deleterious effect of such ions on the absorbent material, the filter material acts to remove or filter ions from the downhole fluids before they interact with the swellable material. By remove or filter, it is meant that the filter material captures or holds the ions in, at, or proximate a capture site or location proximate to the filter material, or otherwise neutralizes the ions such that the flow of fluid is at least partially relatively devoid of ions downstream of the filter material. Thus, while the ions are still technically in the fluid, they are prevented from adversely affecting the swelling of the swellable material and therefore considered to be removed or filtered. The removal, filtering, or capture may be done by chemical or physical bonding between the filter material and the ions, physisorption or chemisorption at or by the filter material or a surface thereof, electrostatic and/or van der Waals attraction between the filter material or an atomic structure thereof (e.g., functionalized group) and the ions, etc., examples of which are discussed in more detail below.

Figure 2:
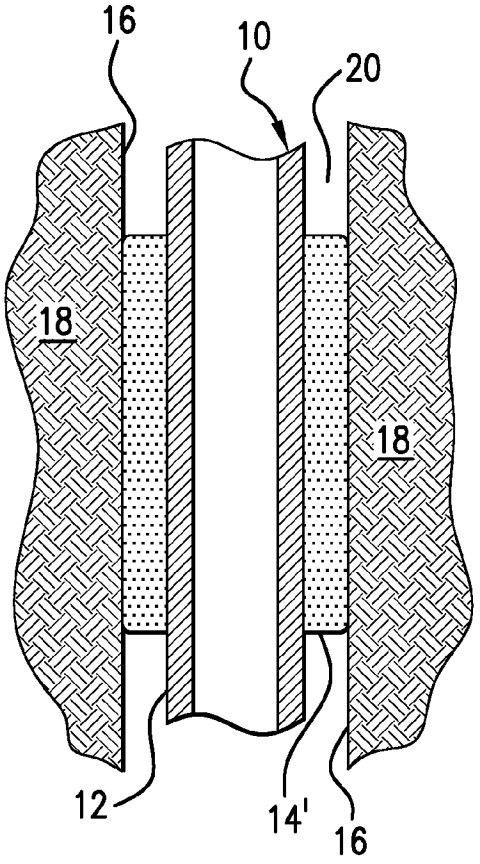
FIG. 2 is a cross-sectional view of the swellable article of FIG. 1 in a swelled configuration.
Figure 3:
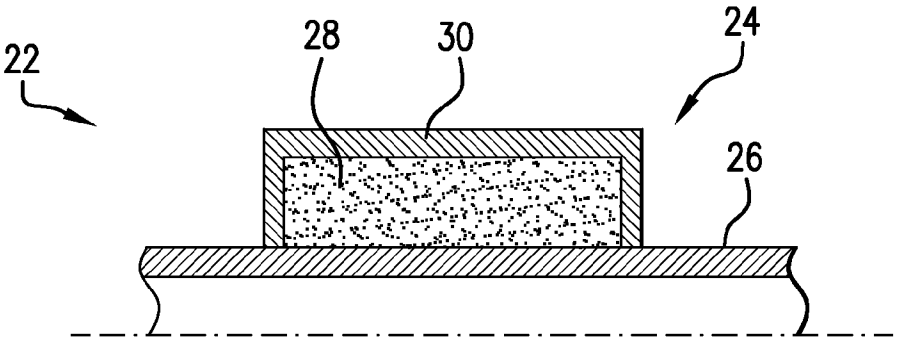
FIG. 3 is a swellable system according to an embodiment disclosed herein where a swellable article is disposed with a filter material in a shell covering a swellable core.

In the embodiment of FIGS. 1 and 2, the filter material, the elastomeric material, and/or the absorbent material can all be mixed together, e.g., homogeneously, then formed into the article 14. An alternate embodiment for a system 22 is shown in FIG. 3, the system 22 including an article 24 on a tubular or string 26. The article 24 is formed from a core 28 and a shell 30. In this embodiment, the core 28 includes the aforementioned swellable material, while the shell 30 includes the filter material. The core 28 and the shell 30 may both, for example, include suitable elastomeric and/or filler materials to provide sealing for the article 24 and to impart chemical and physical properties to the article 24. In this way, the flow of fluid to which the swellable material in the core 28 is reactive will first be filtered of ions by the filter material in the shell 30.

Figure 4:
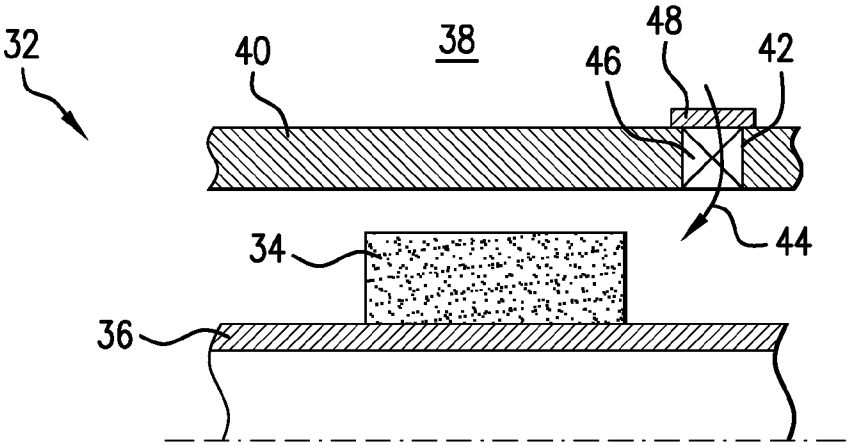
FIG. 4 is a swellable system according to another embodiment disclosed herein where a filter material is separately disposed from a swellable article.

A system 32 according to another embodiment is shown in FIG. 4 in which a swellable article 34 is disposed with a tubular or string 36. In this embodiment, a formation 38 is separated from the article 34 by a radially disposed tubular or string 40, e.g., a casing, liner, tubing, etc. The tubular/string 40 includes at least one port or opening 42 for enabling a flow of fluid, generally designated by an arrow 44, to encounter the article 34. The filter material can be arranged in a plug 46 positioned in the opening 42, in a membrane or film 48 positioned over the opening 42, etc. The plug 46 can be formed as any suitable fluid permeable member for creating a passageway for communicating fluid to the swellable material. In this way, the flow of fluid is filtered by the filter material before it reaches the article 34. The plug 46 and/or the membrane 48 could be formed from any suitable permeable material, e.g., a porous foam, fibers, with the filter material disposed in or with the permeable material, e.g., in pores of the permeable material.

In another embodiment, essentially a combination of the above, the shell 30 could be a protective or elastomeric shell impermeable to downhole fluids and resistant to corrosion and degradation. A permeable plug, such as discussed with respect to the plug 46 could be included in the shell 30 as opposed the an outer tubular 40. In this way, the swellable article will benefit from an outer shell made of an elastomeric or other material that can be selected to provide beneficial properties such as corrosion resistance, fluid impermeability, etc., while also maintaining the advantageous ion filtering properties provided by the current invention as discussed herein.

In one embodiment, the filter material comprises one or more graphene-based compounds. By graphene-based it is meant a compound that includes or is derived from graphene, such as graphene itself, graphite, graphite oxide, graphene oxide, etc. The compounds could take any form used with such graphene-based compounds, such as sheets or nanosheets, particles, flakes, nanotubes, etc. Advantageously, the unique properties of graphene enable effective donor—acceptor interactions between both the anions and the cations and the graphene flakes or particles. The graphene-based materials, associated oxides, or other derivatives or functionalized compounds thereof may contain a corresponding relatively large number of capture sites for attracting and binding ions via van der Waals and/or Coulombic interactions. Of course, other materials with electron-rich surfaces can be used for similarly filtering cations, while highly electron deficient materials may be utilized with respect to anions.

To further increase the ability of graphene-based filter materials to capture the aforementioned polyvalent cations, the filter materials can be functionalized to include one or more functional groups. The process of forming graphite or graphene oxide, for example, results in the inclusion of various functional groups that are relatively negatively charged (e.g., carboxylic acid groups) or polar (e.g., carbonyl groups). Polyvalent cations will be attracted to and captured by these groups. In one embodiment the filter material is covalently modified with thiol groups according to known diazonium chemistry procedures. Thiol groups are naturally excellent at capturing positively charged ions, notably doubly charged mercury cations, although other metallic cations ions such as the aforementioned $Ca^{2+}$, $Zn^{2+}$, etc., contained in downhole brines will also be readily captured by thiol groups. Other functional groups such as disulfide groups, carboxylic acid, sulfonic acid groups may also be used for their ability to capture polyvalent cations, particularly doubly charged cations. Other functional groups include chelating ligand groups, such as iminodiacetic acid, iminodiacetic acid group, N-[5-amino-1-carboxy-(t-butyl)pentyl]iminodi-t-butylacetate) group, N-(5-amino-1-carboxypentyl)iminodiacetic acid group, N-(5-amino-1-carboxypentyl)iminodiacetic acid tri-t-butyl ester group, aminocaproic nitrilotriacetic acid group, aminocaproic nitrilotriacetic acid tri-tert-butylester group, 2-aminooxyethyliminodiacetic acid group, and others that would be recognized by those of ordinary skill in the art in view of the disclosure herein.

The graphene-based materials could also be functionalized to filter anions, e.g., with quaternary ammonium, quaternary phosphonium, ternary sulfonium, cyclopropenylium cations, or primary, secondary, ternary amino, or other groups. These groups are either positively charged or become protonated in acidic environments and thus require anions to compensate for the charge. In some situations, the anion can be exchanged with another anion while preserving charge. For example, in one embodiment, the graphene-based material is functionalized with a quaternary ammonium group, the positive charge of which is balanced by hydroxide anions. In this example, in brine containing $SO_4^{2-}$ anions, one $SO_4^{2-}$ anion will be captured and two hydroxide anions ($OH^-$) will be released. In an embodiment, a mixture of graphene-based material functionalized with sulfonic acid groups and graphene-based material functionalized with quarternary ammonium groups balanced by hydroxide anions is used to neutralize a $CaCl_2$ brine. In the cation-exchange process, $Ca^{2+}$ cations are captured with a simultaneous release of two $H^+$ ions for each $Ca^{2+}$ cation. In the anion-exchange process, $Cl^-$ ions are captured by the quaternary ammonium group with a simultaneous release of $OH^-$ anion for each $Cl^-$ ion. Recombination of released $H^+$ and $OH^-$ ions results in the formation of water molecules, which may contribute to the swelling process of water-swellable materials.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A swellable system reactive to a flow of fluid, comprising:

an article including a swellable material operatively arranged to swell upon exposure to the flow of fluid, the fluid being aqueous and containing metallic cations from dissolved salts; and a filter material disposed with the swellable material and operatively arranged to remove the polyvalent cations from the flow of fluid before exposure to the swellable material, the filter material comprising a graphene-based material, the graphene-based material comprising at least one functional group operatively arranged to capture the polyvalent cations;

wherein the filter material and the swellable material are mixed homogeneously in the article.

2. The system of claim 1, wherein the filter material exerts van der Walls forces, Coulombic forces, or combinations thereof on the ions.

3. The system of claim 1, wherein attraction between the filter material and the ions is formed by functional groups attached to the filter material.

4. The system of claim 3, wherein the functional groups are thiol groups, disulfide groups, carboxylic acid groups, sulfonic acid groups, chelating ligand groups, or a combination including at least one of the foregoing.

5. The system of claim 1, wherein the polyvalent cations are di-valent metallic cations.

6. The system of claim 1, wherein the graphene-based material is graphene, graphite, graphene oxide, graphite oxide, or a combination including at least one of the foregoing.

7. The system of claim 6, wherein the at least one functional group is a thiol group, a disulfide group, a carboxylic acid group, a sulfonic acid group, a chelating ligand group, or a combination including at least one of the foregoing.

8. The system of claim 1, further comprising an elastomeric material operatively arranged to enable the article to seal against another structure after swelling.

9. The system of claim 1, wherein the filter material is operatively arranged to remove the metallic cations by capturing the metallic cations, capturing the metallic cations while simultaneously releasing one or more other ions in order to preserve a charge balance, or a combination including at least one of the foregoing.

10. A method of operating a swellable system of claim 1 comprising:

removing metallic cations from a flow of fluid with a filter material; and swelling a swellable material responsive to the flow of fluid upon exposure to the fluid.

11. The method of claim 10, wherein the metallic cations are polyvalent metallic cations.

12. The method of claim 10, wherein the filter material comprises a graphene-based material being graphene, graphite, graphene oxide, graphite oxide, or a combination including at least one of the foregoing.

13. The method of claim 12, wherein the graphene-based material further comprises at least one functional group operatively arranged to capture the ions.

14. The method of claim 13, wherein the at least one functional group is a thiol group, a disulfide group, a carboxylic acid group, a sulfonic acid group, a chelating ligand group, or a combination including at least one of the foregoing.

15. The method of claim 13, wherein the at least one functional group is a quaternary ammonium group, a quaternary phosphonium group, a ternary sulfonium group, a cyclopropenylium cation, a group configured to be protonated in an acidic environment, a primary amino group, a secondary amino group, a ternary amino group, or a combination including at least one of the foregoing.

16. The system of claim 10, wherein removing the metallic cations includes capturing the ions metallic cations, capturing the metallic cations while simultaneously releasing one or more other in order to preserve a charge balance, or a combination including at least one of the foregoing.

17. The system of claim 1, wherein the at least one functional group is a thiol group, a disulfide group, or a combination including at least one of the foregoing.

18. The system of claim 1, wherein the at least one functional group is a chelating ligand group.

* * * * *